US006299758B1

(12) United States Patent
Okazaki et al.

(10) Patent No.: US 6,299,758 B1
(45) **Date of Patent: *Oct. 9, 2001**

(54) LOW SULFUR GAS OIL

(75) Inventors: Hajime Okazaki; Katsuhiko Ishikawa; Michiaki Adachi; Toshio Waku, all of Yokohama (JP)

(73) Assignee: Nippon Mitsubishi Oil Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/437,942

(22) Filed: Nov. 10, 1999

(30) Foreign Application Priority Data

Nov. 11, 1998 (JP) ..... 10-320303

(51) Int. Cl.[7] ..... C10G 45/00

(52) U.S. Cl. ..... 208/15; 208/57; 208/143; 208/144

(58) Field of Search ..... 208/15

(56) References Cited

U.S. PATENT DOCUMENTS

| | | | | |
|---|---|---|---|---|
| 5,183,556 | * | 2/1993 | Reilly et al. | 208/57 |
| 5,316,658 | * | 5/1994 | Ushio et al. | 208/216 R |
| 5,391,291 | * | 2/1995 | Winquist et al. | 208/143 |
| 5,730,762 | * | 3/1998 | Murakami et al. | 44/329 |
| 5,976,201 | * | 11/1999 | Barry et al. | 44/413 |
| 6,039,771 | * | 3/2000 | Selvidge et al. | 44/311 |

* cited by examiner

*Primary Examiner*—Ellen M. McAvoy
(74) *Attorney, Agent, or Firm*—Akin, Gump, Strauss, Hauer & Feld, L.L.P.

(57) ABSTRACT

Gas oils comprises one or more gas oil bases obtained by subjecting specific fractions from distilled petroleum fractions to hydrogenating treatment under specific conditions and optionally a small amount of a straight kerosene or gas oil. The gas oils have a sulfur concentration of 350 ppm or below.

20 Claims, No Drawings

LOW SULFUR GAS OIL

BACKGROUND OF THE INVENTION

1. Field of the Invention

This invention relates to low sulfur gas oils derived from petroleum distillation fractions, and more particularly to low sulfur gas oils suitable for use as a diesel oil.

2. Description of the Prior Art

Currently, diesel gas oils have been produced by mixing a desulfurized gas oil base obtained by treating a straight gas oil using a conventional desulfurization reaction apparatus, with base materials or gas oil fractions. Such base materials are those produced by hydrocracking a heavy oil. Such gas oil fractions are those produced by thermal cracking or catalytic cracking a heavy oil. On the circumstances, the base material are those obtained by hydro-refining such gas oil fractions. In this connection, there are two choices to reduce the sulfur concentration of a final gas oil. One is to reduce the sulfur concentration of each base materials. The other is to produce a base material of an extremely low sulfur concentration and then to mix it with another base material to an extent of allowable sulfur concentration.

However, recent issues concerning with the environment have required reducing the amounts of NOx and particulates contained in the exhaust gas of diesel engine automobiles. In many foreign countries, there are some movements regarding a regulation emphasizing to decrease the sulfur concentration of diesel gas oils. Specifically, the regulation requires gradually bringing down the sulfur concentration of a diesel oil from 500 ppm which is currently accepted, to 350 ppm and to 50 ppm in the feature. However, conventional methods are limited to produce a diesel gas oil having a sulfur concentration of 500 ppm.

An object of the present invention is to provide a low sulfur diesel gas oil of less than 350 ppm or below, furthermore 50 ppm or below in sulfur concentration causing the formation of particulates in the exhaust gas of a diesel engine automobile.

It has now been found after an extensive research and study that the expected low sulfur gas oil can be produced by using one or more gas oil bases obtained by hydrogenating some specific fractions of petroleum distillations under the certain conditions or alternatively by mixing one or more of these gas oil bases with a small amount of straight kerosene or gas oil.

According to one aspect of the present invention, there is provided with a low sulfur gas oil at least 90% of total volume which consists of one or more gas oil bases (a) to (d) below and the sulfur concentration of which is no greater than 350 ppm:

(a) a gas oil base produced by hydrodesulfurizating a fraction obtained from an atmospheric pressure distillation column and having a 5% recovered temperature in the range of 140 to 310° C. and a 90% recovered temperature of lower than 340° C., under reaction conditions with a hydrogen partial pressure of 20 to 70 kg/cm$^2$, an LHSV (liquid hourly space velocity) of 1.0 to 20.0 and a reaction temperature of 280 to 450° C.;

(b) a gas oil base produced by hydrodesulfurizating a fraction obtained from an atmospheric pressure distillation column and having a 5% recovered temperature in the range of 140 to 340° C. and a 90% recovered temperature of lower than 340 to 380° C., under reaction conditions with a hydrogen partial pressure of 20 to 150 kg/cm$^2$, an LHSV of 0.1 to 10.0 and a reaction temperature of 330 to 450° C.;

(c) a gas oil base having an initial boiling point of 260° C. or higher and a 90% recovered temperature of 345° C. or below and obtained from fractions produced by hydrocracking a fraction obtained from an atmospheric distillation column and having an initial boiling point of 260° C. or higher and/or a vacuum gas oil obtained from a vacuum distillation column, under reaction conditions with a hydrogen partial pressure of 30 to 100 kg/cm$^2$, an LHSV of 0.1 to 10.0 and a reaction temperature of 330 to 450° C.; and (d) a gas oil base having an initial boiling point of 260° C. or higher and a 90% recovered temperature of 365° C. or below and obtained from fractions produced by hydrocracking a fraction obtained from an atmospheric distillation column and having an initial boiling point of 260° C. or higher in and/or a vacuum gas oil obtained from a vacuum distillation column, under reaction conditions with a hydrogen partial pressure of 100 to 250 kg/cm$^2$, an LHSV of 0.1 to 10.0 and a reaction temperature of 350 to 450° C.

According to the other aspect of the present invention, there is provided a low sulfur gas oil the total volume of which consists of one or more of the above-described gas oil basses (a) to (d) and the sulfur content of which is no greater than 50 ppm.

DETAILED DESCRIPTION OF THE INVENTION

Preparation of Gas Oil Base (a)

The starting material used is a petroleum fraction (A) having a 5% recovered temperature of 140 to 310° C. and a 90% recovered temperature of lower than 340° C. The sulfur concentration of this petroleum fraction is preferably in the range of 0.5 to 2.0 weight percent. The petroleum fraction (A) is subjected to hydrodesulfurization under reaction conditions with a hydrogen partial pressure of 20 to 70 kg/cm$^2$, an LHSV of 0.1 to 20.0 and a reaction temperature of 280 to 450° C.

The hydrogen partial pressure may be selected from the range from 20 to 70 kg/cm$^2$, but is preferably selected within the range from 25 to 65 kg/cm$^2$, and more preferably 30 to 60 kg/cm$^2$.

The LHSV may be selected within the range of 0.1 to 20.0, but is preferably selected within the range of 1.0 to 15.0, and more preferably 2.0 to 10.0.

The reaction temperature may be selected within the range of 280 to 450° C., but is preferably selected within the range of 290 to 410° C., and more preferably 300 to 380° C.

The catalyst used may be those commonly employed to hydrorefining a petroleum distillation fraction. Specific examples of such catalysts are those composed of active metals supported on porous inorganic oxides such as alumina, silica, titania, boria, zirconia, silica-alumina, silica-magnesia, alumina-magnesia, alumina-titania, silica-titania, alumina-boria and alumina-zirconia. The active metals may be one or more types of metals selected from the group consisting of chromium, molybdenum, tungsten, cobalt and nickel. These active metals may be supported on the carrier in the form of metals, oxides, sulfides or mixtures thereof. The amount of active metal to be supported on the carrier is preferably in the range of 1 to 20 weight percent in the form of its oxide. The catalyst may be in the form of granules, tablets or columns.

In the present invention, it is preferred to use the catalyst having a combination of two or three different types of active metals, such as cobalt-molybdenum, nickel-molybdenum or cobalt-nickel-molybdenum, support on the alumina carrier.

The catalyst is preferably preliminary sulfurized by a known method prior to its use in the hydrogenation treatment.

The hydrogenation treatment reactor may be in the form of a fixed bed, fluidized bed or expansion bed, but a fixed bed is particularly preferred.

Contact between hydrogen, the petroleum fraction (A) and the catalyst may be conducted using a parallel upward current flow, parallel downward current flow or counter-current flow system.

Preparation of Gas Oil Base (b)

The starting material used is a petroleum fraction (B) having a 5% recovered temperature of 140 to 340° C. and a 90% recovered temperature of 340 to 380° C. The sulfur concentration of this petroleum fraction is preferably in the range of 0.5 to 2.0 weight percent. The petroleum fraction (B) is subjected to hydrodesulfurization under reaction conditions with a hydrogen partial pressure of 20 to 150 kg/cm$^2$, an LHSV of 0.1 to 10.0 and a reaction temperature of 330 to 450° C.

The hydrogen partial pressure may be selected from the range of 20 to 150 kg/cm$^2$, but is preferably selected within the range of 30 to 140 kg/cm$^2$, and more preferably 40 to 120 kg/cm$^2$.

The LHSV may be selected within the range of 0.1 to 10.0, but is preferably selected within the range of 0.7 to 7.0, and more preferably 0.5 to 5.0.

The reaction temperature may be selected within the range of 330 to 450° C., but is preferably selected within the range of 340 to 440° C., and more preferably 350 to 420° C.

The catalyst used may be those commonly employed to hydrorefining a petroleum distillation fraction. Specific examples of such catalysts are those composed of active metals supported on porous inorganic oxides such as alumina, silica, titania, boria, zirconia, silica-alumina, silica-magnesia, alumina-magnesia, alumina-titania, silica-titania, alumina-boria and alumina-zirconia. The active metals may be one or more types of metals selected from the group consisting of chromium, molybdenum, tungsten, cobalt and nickel. These active metals may be supported on the carrier in the form of metals, oxides, sulfides or mixtures thereof. The amount of active metal to be supported on the carrier is preferably in the range of 3 to 20 weight percent in the form of its oxide. The catalyst may be in the form of granules, tablets or columns.

In the present invention, it is preferred to use the catalyst having a combination of two or three different types of active metals, such as cobalt-molybdenum, nickel-molybdenum or cobalt-nickel-molybdenum, support on the alumina carrier.

The catalyst is preferably preliminary sulfurized by a known method to prior to its use in the hydrogenation treatment.

The hydrogenation treatment reactor may be in the form of a fixed bed, fluidized bed or expansion bed, but a fixed bed is particularly preferred. Contact between hydrogen, the petroleum fraction (B) and the catalyst may be conducted using a parallel upward current flow, parallel downward current flow counter-current flow system.

Preparation of Gas Oil Base (c)

The starting material used is a petroleum fraction having an initial boiling point of 260° C. or higher and distilled from an atmospheric pressure distillation column and/or a vacuum gas oil distilled from a vacuum distillation column (hereinafter referred to as petroleum fraction (C ). The sulfur concentration of these petroleum fractions (C) is preferably in the range of 0.5 to 4.0 weight percent. The petroleum fraction (C) is subjected to hydrodesulfurization under reaction conditions with a hydrogen partial pressure of 30 to 100 kg/cm$^2$, an LHSV of 0.1 to 10.0 and a reaction temperature of 330 to 450° C. This reaction produces a gas oil base (c) extremely reduced in sulfur concentration and having an initial boiling point of 260° C. or higher and a 90% recovered temperature of 345° C. or below.

The hydrogen partial pressure may be selected from the range of 30 to 100 kg/cm$^2$, but is preferably selected within the range of 40 to 90 kg/cm$^2$, and more preferably 50 to 80 kg/cm$^2$.

The LHSV may be selected within the range of 0.1 to 10.0, but is preferably selected within the range of 0.2 to 7.0, and more preferably 0.5 to 5.0.

The reaction temperature may be selected within the range of 330 to 450° C., but is preferably selected within the range of 340 to 430° C., and more preferably 360 to 420° C.

The catalyst used may be those commonly employed to hydrorefining a petroleum distillation fraction. Specific examples of such catalysts are those composed of active metals supported on porous inorganic oxides such as alumina, silica, titania, boria, zirconia, silica-alumina, silica-magnesia, alumina-magnesia, magnesia, alumina-titania, silica-titania, alumina-boria and alumina-zirconia. The active metals may be at least one type of metal selected from the group consisting of chromium, molybdenum, tungsten, cobalt and nickel. These active metals may be supported on the carrier in the form of metals, oxides, sulfides or mixtures thereof. The amount of active metal to be supported on the carrier is preferably in the range of 1 to 20 weight percent in the form of its oxide. The catalyst may be in the form of granules, tablets or columns.

In the present invention, it is preferred to use the catalyst having a combination of two or three different types of active metals, such as cobalt-molybdenum, nickel-molybdenum or cobalt-nickel-molybdenum, support on the silica-alumina or alumina-boria carrier. The carrier may further contain zeolite.

Upon the hydrogenation reaction, various types of the catalyst composed of the above-described active metal and carrier may be used by piling in the same reactor or by charging into a multi-step reactor.

The catalyst is preferably preliminary sulfurized by a known method to prior to its use in the hydrogenation treatment.

The hydrogenation treatment reactor may be in the form of a fixed bed, fluidized bed or expansion bed, but a fixed bed is particularly preferred. Contact between hydrogen, the petroleum fraction (C) and the catalyst may be conducted using a parallel upward current flow, parallel downward current flow or counter-current flow system.

Preparation of Gas Oil Base (d)

The starting material used is a petroleum fraction having an initial boiling point of 260° C. or higher and distilled from an atmospheric pressure distillation column and/or a vacuum gas oil distilled from a vacuum distillation column (hereinafter referred to as petroleum fraction (D) ). The sulfur concentration of these petroleum fractions (D) is preferably in the range of 0.5 to 4.0 weight percent. The petroleum fraction (D) is subjected to hydrodesulfurization under reaction conditions with a hydrogen partial pressure of 100 to 250 kg/cm$^2$, an LHSV of 0.01 to 10.0 and a reaction temperature of 350 to 450° C. This reaction produces a gas oil base (d) extremely reduced in sulfur concentration and having an initial boiling point of 260° C. or higher and a 90% recovered temperature of 345° C. or below.

The hydrogen partial pressure may be selected from the range of 100 to 250 kg/cm$^2$, but is preferably selected within the range of 105 to 200 kg/cm$^2$, and more preferably 110 to 180 kg/cm$^2$.

The LHSV may be selected within the range of 0.01 to 10.0,but is preferably selected within the range of 0.05 to 7.0,and more preferably 0.1 to 3.0.

The reaction temperature may be selected within the range of 350 to 450° C., but is preferably selected within the range of 355 to 430° C., and more preferably 360 to 420° C.

The catalyst used may be those commonly employed to hydrorefining a petroleum distillation fraction. Specific examples of such catalysts are those composed of active metals supported on porous inorganic oxides such as alumina, silica, titania, boria, zirconia, silica-alumina, silica-magnesia, alumina-magnesia, alumina-titania, silica-titania, alumina-boria and alumina-zirconia. The porous inorganic oxide may contain 10 or less weight percent of zeolite. The active metals may be at least one type of metal selected from the group consisting of chromium, molybdenum, tungsten, cobalt and nickel. These active metals may be supported on the carrier in the form of metals, oxides, sulfides or mixtures thereof. The amount of active metal to be supported on the carrier is preferably in the range of 1 to 20 weight percent in the form of its oxide. The catalyst may be in the form of granules, tablets or columns.

In the present invention, it is preferred to use the catalyst having an active metal, such as cobalt-molybdenum, nickel-molybdenum, cobalt-nickel-molybdenum, cobalt-tungsten, nickel-tungsten and cobalt-nickel-tungst supported on the silica-alumina, silica-titania-alumina or silica-zirconia-alumina carrier. These carriers may further contain zeolite.

Upon the hydrogenation reaction, various types of the catalyst composed of the above-described active metal and carrier may be used by piling in the same reactor or by charging into a multi-step reactor.

The catalyst is preferably preliminary sulfurized by a known method to prior to its use in the hydrogenation treatment.

The hydrogenation treatment reactor may be in the form of a fixed bed, fluidized bed or expansion bed, but a fixed bed is particularly preferred.

Contact between hydrogen, the petroleum fraction (D) and the catalyst may be conducted using a parallel upward current flow, parallel downward current flow or counter-current flow system.

The inventive low sulfur gas oil having a sulfur concentration of greater than 50 ppm and no greater than 350 ppm contains one or more of the above-described gas oil bases (a) to (d) in an amount of more than 90 volume percent, preferably 93 volume percent. If more than two of the gas oil bases are mixed, the blend ration is not particularly limited.

Due to the low sulfur concentration of gas oil bases (a) to (d), 10 volume percent or below of other straight petroleum fraction may be mixed therewith so as to obtain a sulfur concentration of greater than 50 ppm and no greater than 350 ppm. The straight petroleum fraction may be a straight kerosene or a straight gas oil. The straight kerosene used herein has preferably a sulfur concentration of 0.05 to 0.4%, a 5% recovered temperature of 130 to 220° C. and a 90% recovered temperature of 260° C. or below. The straight gas oil has preferably a sulfur concentration of 0.3 to 2.0%, a 5% recovered temperature of 140 to 340° C. and a 90% recovered temperature of 340 to 380° C.

The straight petroleum fraction may be the base fractions of gas oil bases (a) and (b) and mixtures thereof.

The inventive low sulfur gas oil having a sulfur concentration of less than 50 ppm, preferably within the range of 50 to 10 ppm may be derived from at least one of the above-mentioned gas oil base (a) to (d). No particular limitation is imposed on the blend ratio of these gas oil bases.

For the purposes of improving cetane number, engine detergency properties and lubricity, various types of additives may be added to the low sulfur gas oil according to the present invention.

The invention will be further described by way of the following examples which are provided for illustrative purposes only.

EXAMPLES

The following gas oil bases were prepared in a manner described below.

Preparation of Gas Oil Bases 1-1 to 1-4

TABLE 1

| Gas oil Base | Hydrogen partial Pressure kg/cm$^2$ | LHSV | Temperature ° C. |
|---|---|---|---|
| 1-1 | 35 | 5 | 340 |
| 1-2 | 15 | 5 | 340 |
| 1-3 | 35 | 23 | 340 |
| 1-4 | 35 | 5 | 260 |

Gas oil bases 1-1 through 1-4 were prepared by subjecting a straight petroleum fraction having a sulfur concentration of 0.7%, a 5% recovered temperature of 150° C. and a 90 recovered temperature of 330° C., to hydrodesulfurization under the conditions indicated in Table 1. The catalyst used was one having 4 weight percent of cobalt and 15 weight percent of molybdenum supported on an alumina carrier.

Preparation of Gas Oil Bases 2-1 to 2-4

TABLE 2

| Gas oil Base | Hydrogen partial Pressure kg/cm$^2$ | LHSV | Temperature ° C. |
|---|---|---|---|
| 2-1 | 70 | 1.5 | 360 |
| 2-2 | 15 | 1.5 | 360 |
| 2-3 | 70 | 12 | 360 |
| 2-4 | 70 | 1.5 | 300 |

Gas oil bases 2-1 through 2-4 were prepared by subjecting a straight petroleum fraction having a sulfur concentration of 1.3%, a 5% recovered temperature of 150° C. and a 90 recovered temperature of 365° C., to hydrodesulfurization under the conditions indicated in Table 1. The catalyst used was one having 4 weight percent of cobalt and 15 weight percent of molybdenum supported on an alumina carrier.

Preparation of Gas Oil Bases 3-1 to 3-4

TABLE 3

| Gas oil Base | Hydrogen partial Pressure kg/cm$^2$ | LHSV | Temperature ° C. |
|---|---|---|---|
| 3-1 | 70 | 1.8 | 380 |
| 3-2 | 25 | 1.8 | 380 |
| 3-3 | 70 | 12 | 380 |
| 3-4 | 70 | 1.8 | 260 |

Gas oil bases 3-1 through 3-4 were prepared by dispensing a fraction having an initial boiling point of 265° C. and a 90% recovered temperature of 360° C. from a cracked oil obtained by hydrocracking a mixed oil of 60 weight percent of a straight gas oil having a sulfur concentration of 1.8% and 40 weight percent of a vacuum gas oil under the conditions indicated in Table 3. The catalyst used for the hydrocracking reaction was one having 5 weight percent of nickel and 20 weight percent of molybdenum supported on an alumina-silica carrier.

Preparation of Gas Oil Bases 4-1 to 4-4

TABLE 4

| Gas oil Base | Hydrogen partial Pressure kg/cm$^2$ | LHSV | Temperature ° C. |
|---|---|---|---|
| 4-1 | 120 | 1 | 380 |
| 4-2 | 70 | 1 | 380 |
| 4-3 | 120 | 11 | 380 |
| 4-4 | 120 | 1 | 330 |

Gas oil bases 4-1 through 4-4 were prepared by dispensing a fraction having an initial boiling point of 265° C. and a 90% recovered temperature of 340° C. from a cracked oil obtained by hydrocracking a vacuum gas oil having a sulfur concentration of 2.3% under the conditions indicated in Table 4. The catalyst used for the hydrocracking reaction was one having 7 weight percent of nickel and 20 weight percent of tungsten supported on a silica-alumina carrier.

Preparation of Gas Oil Base 5-1

Gas oil base 5-1 was prepared by subjecting a straight petroleum fraction with a sulfur concentration of 0.2%, a 5% recovered temperature of 150° C. and a 90% recovered temperature of 250° C., to hydrodesulfurization under conditions of a hydrogen partial pressure of 35 kg/cm$^2$, a LHSV of 10 and a reaction temperature of 300° C. The catalyst used was one having 4 weight percent of cobalt and 15 weight percent of molybdenum supported on an alumina carrier.

EXAMPLE 1

Gas oils were prepared by mixing 95 volume percent of the gas oil bases obtained above with 5 volume percent of a straight kerosene. Table 5 shows the type of gas oil bases and the sulfur concentration of gas oils thus obtained. The properties of the straight kerosene were as follows:

Sulfur concentration=0.15%, 5% recovered temperature=145° C., 90% recovered temperature=245° C.

TABLE 5

| | Type of gas oil base | Sulfur concentration |
|---|---|---|
| Gas oil 1 | Gas oil base 1-1 + straight kerosene | 113 ppm |
| Comparative gas oil 1a | Gas oil base 1-2 + straight kerosene | 417 ppm |
| Comparative gas oil 1b | Gas oil base 1-3 + straight kerosene | 645 ppm |
| Comparative gas oil 1c | Gas oil base 1-4 + straight kerosene | 2,925 ppm |
| Gas oil 2 | Gas oil base 2-1 + straight kerosene | 116 ppm |
| Comparative gas oil 2a | Gas oil base 2-2 + straight kerosene | 503 ppm |
| Comparative gas oil 2b | Gas oil base 2-3 + straight kerosene | 2,925 ppm |
| Comparative gas oil 2c | Gas oil base 2-4 + straight kerosene | 1,500 ppm |
| Gas oil 3 | Gas oil base 3-1 + straight kerosene | 115 ppm |
| Comparative gas oil 3a | Gas oil base 3-2 + straigbt kerosene | 740 ppm |
| Comparative gas oil 3b | Gas oil base 3-3 + straight kerosene | 5,110 ppm |
| Comparative gas oil 3c | Gas oil base 3-4 + straight kerosene | 5,775 ppm |
| Gas oil 4 | Gas oil base 4-1 + straight kerosene | 104 ppm |
| Comparative gas oil 4a | Gas oil base 4-2 + straight kerosene | 417 ppm |

TABLE 5-continued

| | Type of gas oil base | Sulfur concentration |
|---|---|---|
| Comparative gas oil 4b | Gas oil base 4-3 + straight kerosene | 2,450 ppm |
| Comparative gas oil 4c | Gas oil base 4-4 + straight kerosene | 911 ppm |

EXAMPLE 2

Gas oils were prepared by mixing two types of the gas oil bases obtained above in an amount of 46 volume percent, respectively and 8 volume percent of a straight kerosene. Table 6 shows the type of gas oil bases and the sulfur concentration of gas oils thus obtained. The properties of the straight kerosene were as follows:

Sulfur concentration=0.15%, 5% recovered temperature=145° C., 90% recovered temperature=245° C.

TABLE 6

| | Types of gas oil base | Sulfur concentration |
|---|---|---|
| Gas oil 5 | Gas oil base 1-1 + Gas oil base 2-1 + straight kerosene | 158 ppm |
| Gas oil 6 | Gas oil base 1-1 + Gas oil base 3-1 + straight kerosene | 158 ppm |
| Gas oil 7 | Gas oil base 1-1 + Gas oil base 4-1 + straight kerosene | 152 ppm |
| Gas oil 8 | Gas oil base 1-1 + Gas oil base 5-1 + straight kerosene | 145 ppm |
| Gas oil 9 | Gas oil base 2-1 + Gas oil base 3-1 + straight kerosene | 159 ppm |
| Gas oil 10 | Gas oil base 2-1 + Gas oil base 4-1 + straight kerosene | 154 ppm |
| Gas oil 11 | Gas oil base 2-1 + Gas oil base 5-1 + straight kerosene | 147 ppm |
| Gas oil 12 | Gas oil base 3-1 + Gas oil base 4-1 + straight kerosene | 153 ppm |
| Gas oil 13 | Gas oil base 3-1 + Gas oil base 5-1 + straight kerosene | 146 ppm |
| Gas oil 14 | Gas oil base 4-1 + Gas oil base 5-1 + straight kerosene | 141 ppm |

EXAMPLE 3

Gas oils were prepared by mixing three types of the gas oil bases obtained above in an amount of 31 volume percent, respectively and 7 volume percent of a straight kerosene. Table 7 shows the types of gas oil base and the sulfur concentration of gas oils thus obtained. The properties of the straight kerosene were as follows:

Sulfur concentration=0.15%, 5% recovered temperature=145° C., 90% recovered temperature=245° C.

TABLE 7

| | Type of gas oil base | Sulfur concentration |
|---|---|---|
| Gas oil 15 | Gas oil base 1-1 + Gas oil base 2-1 + Gas oil base 3-1 + straight kerosene | 144 ppm |
| Gas oil 16 | Gas oil base 1-1 + Gas oil base 2-1 + Gas oil base 4-1 + straight kerosene | 140 ppm |
| Gas oil 17 | Gas oil base 1-1 + Gas oil base 2-1 + Gas oil base 5-1 + straight kerosene | 135 ppm |
| Gas oil 18 | Gas oil base 1-1 + Gas oil base 3-1 + | 140 ppm |

TABLE 7-continued

| | Type of gas oil base | Sulfur concentration |
|---|---|---|
| | Gas oil base 4-1 + straight kerosene | |
| Gas oil 19 | Gas oil base 1-1 + Gas oil base 3-1 + Gas oil base 5-1 + straight kerosene | 135 ppm |
| Gas oil 20 | Gas oil base 1-1 + Gas oil base 4-1 + Gas oil base 5-1 + straight kerosene | 131 ppm |
| Gas oil 21 | Gas oil base 2-1 + Gas oil base 3-1 + Gas oil base 4-1 + straight kerosene | 141 ppm |
| Gas oil 22 | Gas oil base 2-1 + Gas oil base 3-1 + Gas oil base 5-1 + straight kerosene | 132 ppm |
| Gas oil 23 | Gas oil base 2-1 + Gas oil base 4-1 + Gas oil base 5-1 + straight kerosene | 132 ppm |
| Gas oil 24 | Gas oil base 3-1 + Gas oil base 4-1 + Gas oil base 5-1 + straight kerosene | 132 ppm |

EXAMPLE 4

Gas oils were prepared by mixing four types of the gas oil bases obtained above in an amount of 23 volume percent, respectively and 8 volume percent of a straight kerosene. Table 8 shows the type of gas oil base and the sulfur concentration of gas oils thus obtained. The properties of the straight kerosene were as follows:

Sulfur concentration=0.15%, 5% recovered temperature=145° C., 90% recovered temperature=245° C.

TABLE 8

| | Type of gas oil base | Sulfur concentration |
|---|---|---|
| Gas oil 25 | Gas oil base 1-1 + Gas oil base 2-1 + Gas oil base 3-1 + Gas oil base 4-1 + straight kerosene | 156 ppm |
| Gas oil 26 | Gas oil base 1-1 + Gas oil base 2-1 + Gas oil base 3-1 + Gas oil base 5-1 + straight kerosene | 152 ppm |
| Gas oil 27 | Gas oil base 1-1 + Gas oil base 2-1 + Gas oil base 4-1 + Gas oil base 5-1 + straight kerosene | 149 ppm |
| Gas oil 28 | Gas oil base 1-1 + Gas oil base 3-1 + Gas oil base 4-1 + Gas oil base 5-1 + straight kerosene | 150 ppm |
| Gas oil 29 | Gas oil base 2-1 + Gas oil base 3-1 + Gas oil base 4-1 + Gas oil base 5-1 + straight kerosene | 149 ppm |

EXAMPLE 5

Gas oil 30 was prepared by mixing gas oil bases 1-1, 2-1, 3-1 and 4-1 in an amount of 19 volume percent, respectively and 5 volume percent of a straight kerosene. The sulfur concentration of the gas oil was 107 ppm. The properties of the straight kerosene were as follows: Sulfur concentration=0.15%, 5% recovered temperature=145° C., 90% recovered temperature=245° C.

EXAMPLE 6

Gas oils were prepared by mixing two types of gas oil bases in an amount of 50 volume percent, respectively. Table 9 shows the type of gas oil base and the sulfur concentration of the gas oils thus obtained.

TABLE 9

| | Types of gas oil base | Sulfur concentration |
|---|---|---|
| Gas oil 31 | Gas oil base 1-1 + Gas oil base 2-1 | 42 ppm |
| Comparative gas oil 31a | Gas oil base 1-1 + Gas oil base 2-2 | 245 ppm |
| Gas oil 32 | Gas oil base 1-1 + Gas oil base 3-1 | 41 ppm |
| Comparative gas oil 32a | Gas oil base 1-1 + Gas oil base 3-3 | 2,670 ppm |
| Gas oil 33 | Gas oil base 1-1 + Gas oil base 4-1 | 35 ppm |
| Comparative gas oil 33a | Gas oil base 1-1 + Gas oil base 4-4 | 460 ppm |
| Gas oil 34 | Gas oil base 1-1 + Gas oil base 5-1 | 28 ppm |
| Gas oil 35 | Gas oil base 2-1 + Gas oil base 3-1 | 43 ppm |
| Comparative gas oil 35a | Gas oil base 2-1 + Gas oil base 3-2 | 372 ppm |
| Gas oil 36 | Gas oil base 2-1 + Gas oil base 4-1 | 37 ppm |
| Comparative gas oil 36a | Gas oil base 2-1 + Gas oil base 4-3 | 1,272 ppm |
| Gas oil 37 | Gas oil base 2-1 + Gas oil base 5-1 | 29 ppm |
| Gas oil 38 | Gas oil base 3-1 + Gas oil base 4-1 | 36 ppm |
| Gas oil 39 | Gas oil base 3-1 + Gas oil base 5-1 | 29 ppm |
| Gas oil 40 | Gas oil base 4-1 + Gas oil base 5-1 | 23 ppm |

EXAMPLE 7

Gas oils were prepared by mixing three types of gas oil bases. Table 10 shows the types of gas oil base and the sulfur concentration of the gas oils thus obtained. The first gas oil base indicated in the column of "Types of gas oil base" in Table 10 were used in an amount of 34 volume percent and while the second and third gas oil bases were used in an amount of 33 volume percent, respectively.

TABLE 10

| | Types of gas oil base | Sulfur concentration |
|---|---|---|
| Gas oil 41 | Gas oil base 1-1 + Gas oil base 2-1 + Gas oil base 3-1 | 42 ppm |
| Comparative gas oil 41a | Gas oil base 1-1 + Gas oil base 2-1 + Gas oil base 3-4 | 2,008 ppm |
| Gas oil 42 | Gas oil base 1-1 + Gas oil base 2-1 + Gas oil base 4-1 | 38 ppm |
| Comparative gas oil 42a | Gas oil base 1-1 + Gas oil base 2-1 + Gas oil base 4-2 | 147 ppm |
| Gas oil 43 | Gas oil base 1-1 + Gas oil base 2-1 + Gas oil base 5-1 | 33 ppm |
| Gas oil 44 | Gas oil base 1-1 + Gas oil base 3-1 + Gas oil base 4-1 | 37 ppm |
| Gas oil 45 | Gas oil base 1-1 + Gas oil base 3-1 + Gas oil base 5-1 | 32 ppm |
| Comparative gas oil 45a | Gas oil base 1-2 + Gas oil base 3-1 + Gas oil base 5-1 | 141 ppm |
| Gas oil 46 | Gas oil base 1-1 + Gas oil base 4-1 + Gas oil base 5-1 | 28 ppm |
| Gas oil 47 | Gas oil base 2-1 + Gas oil base 3-1 + Gas oil base 4-1 | 38 ppm |
| Gas oil 48 | Gas oil base 2-1 + Gas oil base 3-1 + Gas oil base 5-1 | 33 ppm |
| Gas oil 49 | Gas oil base 2-1 + Gas oil base 4-1 + Gas oil base 5-1 | 29 ppm |
| Gas oil 50 | Gas oil base 3-1 + Gas oil base 4-1 + Gas oil base 5-1 | 29 ppm |

EXAMPLE 8

Gas oils were prepared by mixing four types of gas oil bases in an amount of 25 volume percent, respectively. Table 11 shows the types of gas oil base and the sulfur concentration of the gas oils thus obtained.

TABLE 11

| | Types of gas oil base | Sulfur concentration |
|---|---|---|
| Gas oil 51 | Gas oil base 1-1 + Gas oil base 2-1 + Gas oil base 3-1 + Gas oil base 4-1 | 39 ppm |
| Gas oil 52 | Gas oil base 1-1 + Gas oil base 2-1 + Gas oil base 3-1 + Gas oil base 5-1 | 35 ppm |
| Gas oil 53 | Gas oil base 1-1 + Gas oil base 2-1 + Gas oil base 4-1 + Gas oil base 5-1 | 32 ppm |
| Gas oil 54 | Gas oil base 1-1 + Gas oil base 3-1 + Gas oil base 4-1 + Gas oil base 5-1 | 32 ppm |
| Gas oil 55 | Gas oil base 2-1 + Gas oil base 2-1 + Gas oil base 4-1 + Gas oil base 5-1 | 33 ppm |

EXAMPLE 9

Gas oil 56 was prepared by mixing gas oil bases 1-1, 2-1, 3-1, 4-1 and 5-1 in an amount of 20 volume percent, respectively. The sulfur concentration of the gas oil thus obtained was 34 ppm.

As apparent from the above examples, the present invention can provide a low sulfur diesel gas oil which has a sulfur concentration of 50 ppm or higher and 350 ppm or below. Furthermore, according to the present invention, there is provided a low sulfur diesel gas oil which has a sulfur concentration of 50 ppm or below. The diesel gas oil having a sulfur concentration of 50 ppm or below can suppress the formation of particulate in the exhaust gas from a diesel engine automobile.

What is claimed is:

1. A low sulfur gas oil which has a sulfur concentration of 50 ppm or below and consists essentially of at least one gas oil base selected from the group consisting of:

(a) a gas oil base produced by hydrodesulfurizing a fraction obtained from an atmospheric pressure distillation column and having a 5% recovered temperature in the range of 140 to 310° C. and a 90% recovered temperature of lower than 340° C., under reaction conditions with a hydrogen partial pressure of 20 to 70 kg/cm$^2$, an LHSV of 1.0 to 20.0 and a reaction temperature of 280 to 450° C.;

(b) a gas oil base produced by hydrodesulfurizing a fraction obtained from an atmospheric pressure distillation column and having a 5% recovered temperature in the range of 140 to 340° C. and a 90% recovered temperature in the range of 340 to 380° C., under reaction conditions with a hydrogen partial pressure of 20 to 150 kg/cm$^2$, an LHSV of 0.1 to 10.0 and a reaction temperature of 330 to 450° C.;

(c) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 30 to 100 kg/cm$^2$, an LHSV of 0.1 to 10.0 and a reaction temperature of 330 to 450° C.; and (d) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 100 to 250 kg/cm$^2$, an LHSV of 0.01 to 10.0 and a reaction temperature of 350 to 450° C.

2. The low sulfur gas oil according to claim 1, consisting essentially of a mixture of at least one gas oil base selected from the group consisting of gas oil bases (a) and (b) and at least one gas oil base selected from the group consisting of gas oil bases (c) and (d).

3. The low sulfur gas oil according to claim 1, further comprising additives.

4. The low sulfur gas oil according to claim 2, further comprising additives.

5. A low sulfur gas oil which has a sulfur concentration of greater than 50 ppm and no greater than 350 ppm and comprises 90 volume % or more of at least one gas oil base selected from the group consisting of:

(c) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 30 to 100 kg/cm$^2$, an LHSV of 0.1 to 10.0 and a reaction temperature of 330 to 450° C.; and (d) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 100 to 250 kg/cm$^2$,an LHSV of 0.01 to 10.0 and a reaction temperature of 350 to 450° C.

6. The low sulfur gas oil according to claim 5, further comprising 10 volume % or less of a straight petroleum fraction selected from the group consisting of a straight kerosene and a straight gas oil.

7. The low sulfur gas oil according to claim 6, wherein said straight kerosene has a sulfur concentration from 0.05 to 0.4%, a 5% recovered temperature from 130 to 220° C. and a 90% recovered temperature of 260° C. or below.

8. The low sulfur gas oil according to claim 6, wherein said straight gas oil has a sulfur concentration from 0.3 to 2.0%, a 5% recovered temperature from 140 to 340° C. and a 90% recovered temperature of 340 to 380° C.

9. The low sulfur gas oil according to claim 5, further comprising additives.

10. The low sulfur gas oil according to claim 6, further comprising additives.

11. The low sulfur gas oil according to claim 7, further comprising additives.

12. The low sulfur gas oil according to claim 8, further comprising additives.

13. A low sulfur gas oil which has a sulfur concentration of greater than 50 ppm and no greater than 350 ppm and comprises 90 volume % or more of a mixture consisting of at least one gas oil base selected from the group consisting of:

(a) a gas oil base produced by hydrodesulfurizing a fraction obtained from an atmospheric pressure distillation column and having a 5% recovered temperature in the range of 140 to 310° C. and a 90% recovered temperature of lower than 340° C., under reaction conditions with a hydrogen partial pressure of 20 to 70 $kg/cm^2$, an LHSV of 1.0 to 20.0 and a reaction temperature of 280 to 450° C.;

(b) a gas oil base produced by hydrodesulfurizing a fraction obtained from an atmospheric pressure distillation column and having a 5% recovered temperature in the range of 140 to 340° C. and a 90% recovered temperature in the range of 340 to 380° C., under reaction conditions with a hydrogen partial pressure of 20 to 150 $kg/cm^2$, an LHSV of 0.1 to 10.0 and a reaction temperature of 330 to 450° C.;

and at least one gas oil base selected from the group consisting of:

(c) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 30 to 100 $kg/cm^2$, an LHSV of 0.1 to 10.0 and a reaction temperature of 330 to 450° C.; and (d) a gas oil base having an initial boiling point of 260° C. or higher and a 90% recovered temperature of 345° C. or below, from fractions produced by hydrocracking a fraction obtained from an atmospheric pressure distillation column and having an initial boiling point of 260° C. or higher and/or a vacuum gas oil distilled out from a reduced pressure distillation column, under conditions with a hydrogen partial pressure of 100 to 250 $kg/cm^2$, an LHSV of 0.01 to 10.0 and a reaction temperature of 350 to 450° C.

14. The low sulfur gas oil according to claim 13, further comprising 10 volume % or less of a straight petroleum fraction selected from the group consisting of a straight kerosene and a straight gas oil.

15. The low sulfur gas oil according to claim 14, wherein said straight kerosene as a sulfur concentration from 0.05 to 0.4%, a 5% recovered temperature from 130 to 220° C. and a 90% recovered temperature of 260° C. or below.

16. The low sulfur gas oil according to claim 14, wherein said straight gas oil has a sulfur concentration from 0.3 to 2.0%, a 5% recovered temperature from 140 to 340° C. and a 90% recovered temperature of 340 to 380° C.

17. The low sulfur gas oil according to claim 13, further comprising additives.

18. The low sulfur gas oil according to claim 14, further comprising additives.

19. The low sulfur gas oil according to claim 15, further comprising additives.

20. The low sulfur gas oil according to claim 16, further comprising additives.

* * * * *